US006939187B1

(12) United States Patent
Borroto

(10) Patent No.: US 6,939,187 B1
(45) Date of Patent: Sep. 6, 2005

(54) PERSONAL WATER TRANSPORT ASSEMBLY

(76) Inventor: Miguel Borroto, 2265 SW. 23rd Ter., Miami, FL (US) 33145

( * ) Notice: Subject to any disclaimer, the term of this patent is extended or adjusted under 35 U.S.C. 154(b) by 0 days.

(21) Appl. No.: 10/805,627

(22) Filed: Mar. 22, 2004

(51) Int. Cl.[7] ..... B63B 35/83
(52) U.S. Cl. ..... 441/77; 114/55.56
(58) Field of Search ..... 441/76, 77, 72, 441/70, 60, 61, 62, 63; 440/17, 19, 21; 114/55.56

(56) References Cited

U.S. PATENT DOCUMENTS 2,153,939 A * 4/1939 Schaupp ..... 441/77
2,577,917 A * 12/1951 Homer ..... 441/76
2,808,802 A * 10/1957 Graham ..... 440/19
2,940,090 A * 6/1960 Fournier ..... 441/77
3,144,849 A * 8/1964 Maser ..... 114/55.51
3,833,956 A * 9/1974 Meehan ..... 441/76
4,176,835 A * 12/1979 Aziz ..... 482/140

* cited by examiner

*Primary Examiner*—Sherman Basinger

(57) ABSTRACT

A personal water transport assembly for allowing a user to walk and move easily upon water. The personal water transport assembly includes a floatation assembly including one or more elongate hollow floatation members having top, side, and bottom walls, and also having a foot-receiving slot being centrally-disposed in the top wall for receiving a user's foot; and also includes an assembly of moving the one or more elongate hollow floatation members upon water.

2 Claims, 10 Drawing Sheets

PERSONAL WATER TRANSPORT ASSEMBLY

BACKGROUND OF THE INVENTION

1. Field of the Invention

The present invention relates to personal water transports and more particularly pertains to a new personal water transport assembly for allowing a user to walk and move easily upon water.

2. Description of the Prior Art

The use of personal water transports is known in the prior art. More specifically, personal water transports heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,494,202; U.S. Pat. No. 4,850,483; U.S. Pat. No. 4,356,943; U.S. Pat. No. 1,911,256; U.S. Pat. No. 3,674,189; U.S. Pat. No. 4,893,739; and U.S. Pat. No. Des. 266,201.

While these devices fulfill their respective, particular objectives and requirements, the aforementioned patents do not disclose a new personal water transport assembly. The prior art includes inventions having simply floats with the users being able to place their feet therein and move upon water.

SUMMARY OF THE INVENTION

The general purpose of the present invention, which will be described subsequently in greater detail, is to provide a new personal water transport assembly which has many of the advantages of the personal water transports mentioned heretofore and many novel features that result in a new personal water transport assembly which is not anticipated, rendered obvious, suggested, or even implied by any of the prior art personal water transports, either alone or in any combination thereof. The present invention includes a floatation assembly including one or more elongate hollow floatation members having top, side, and bottom walls, and also having a foot-receiving slot being centrally-disposed in the top wall for receiving a user's foot; and also includes an assembly of moving the one or more elongate hollow floatation members upon water.

There has thus been outlined, rather broadly, the more important features of the personal water transport assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new personal water transport assembly which has many of the advantages of the personal water transports mentioned heretofore and many novel features that result in a new personal water transport assembly which is not anticipated, rendered obvious, suggested, or even implied by any of the prior art personal water transports, either alone or in any combination thereof.

Still another object of the present invention is to provide a new personal water transport assembly for allowing a user to walk and move easily upon water.

Still yet another object of the present invention is to provide a new personal water transport assembly that is easy to wear for a fun-filled time on water.

Even still another object of the present invention is to provide a new personal water transport assembly that a user can use to exercise.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
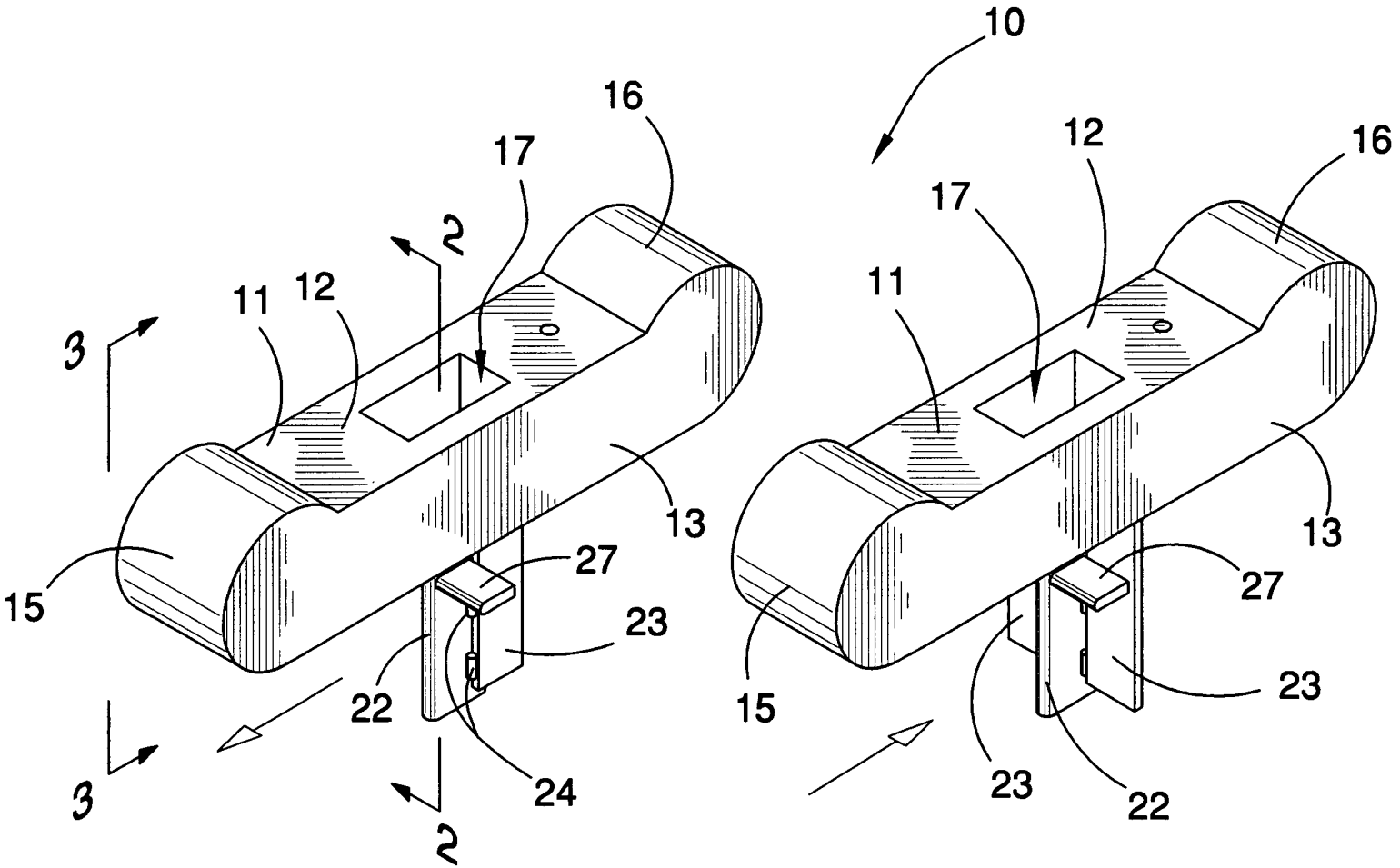
FIG. 1 is a perspective view of a new personal water transport assembly according to the present invention.
Figure 2:
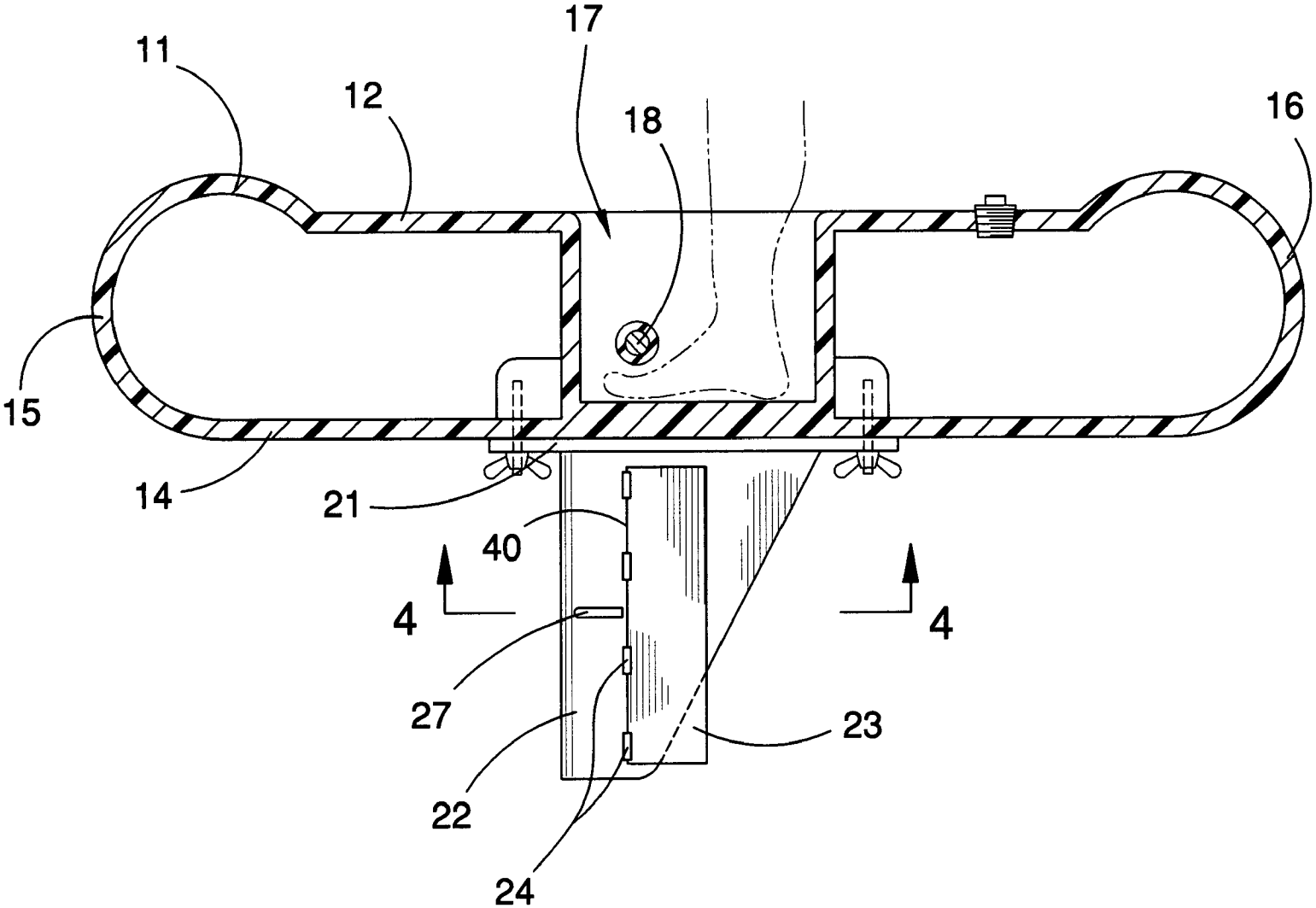
FIG. 2 is a cross-sectional view of the present invention.
Figure 3:
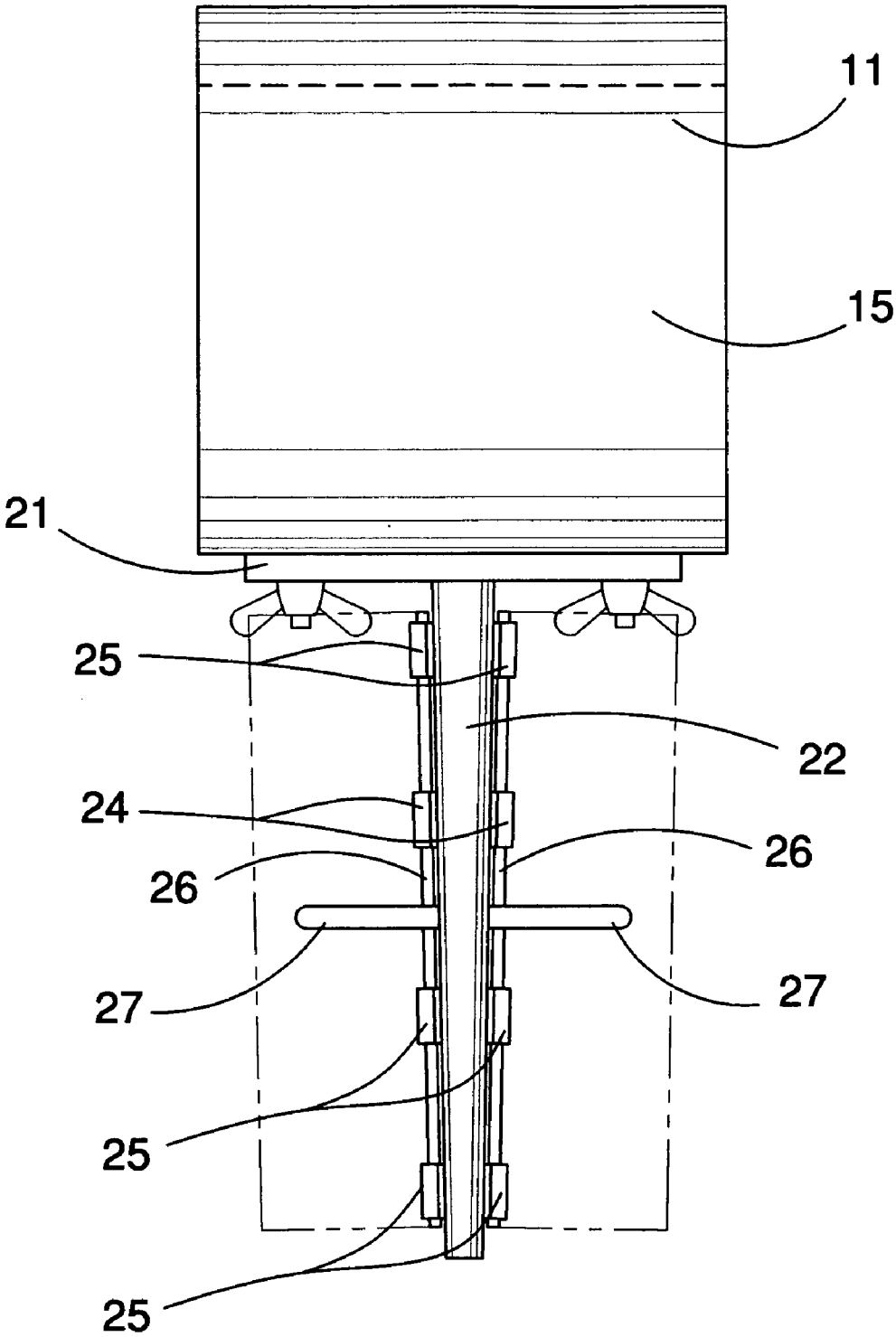
FIG. 3 is a front elevational view of the present invention.
Figure 4:
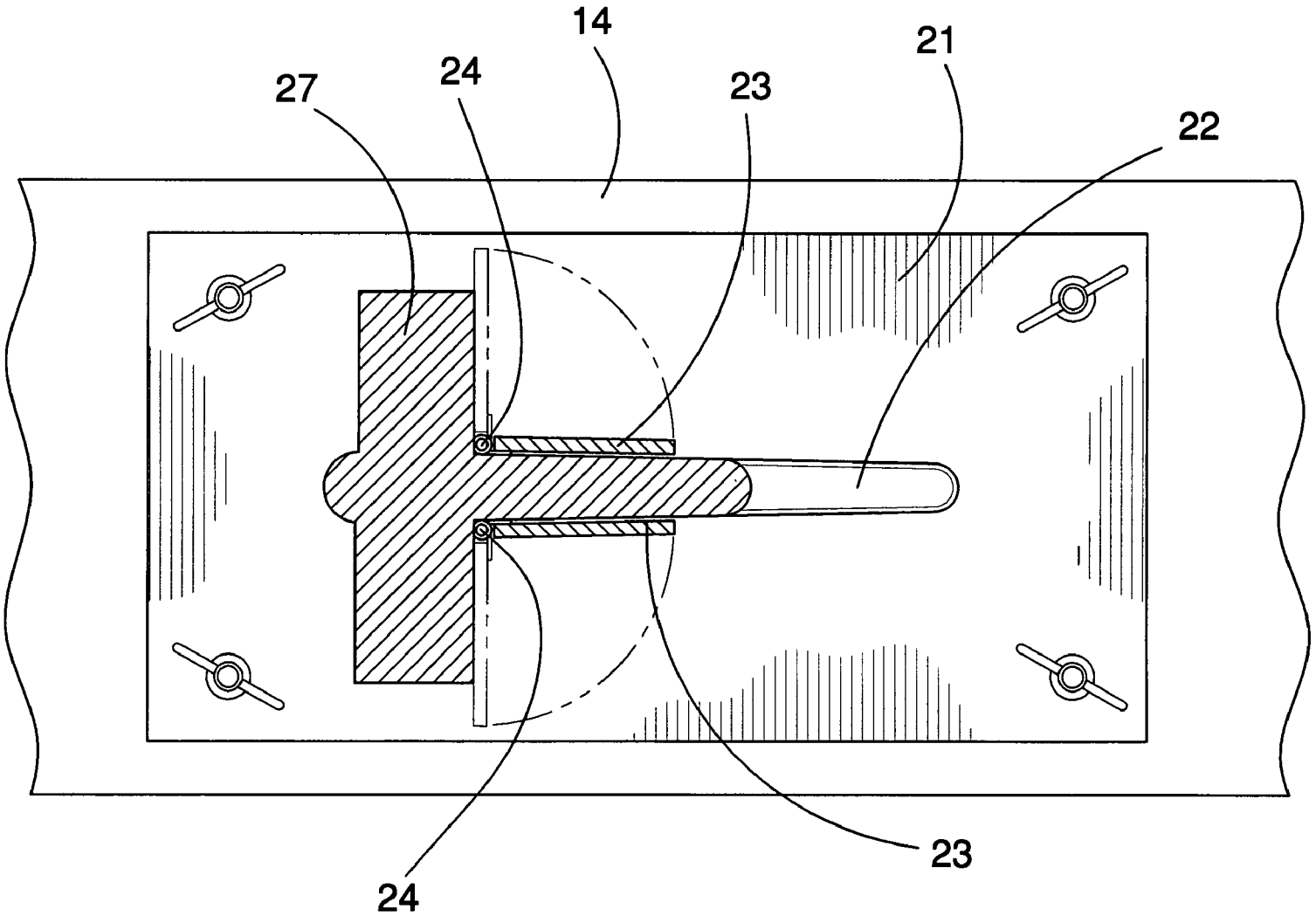
FIG. 4 is a bottom cross-sectional view of the present invention.
Figure 5:
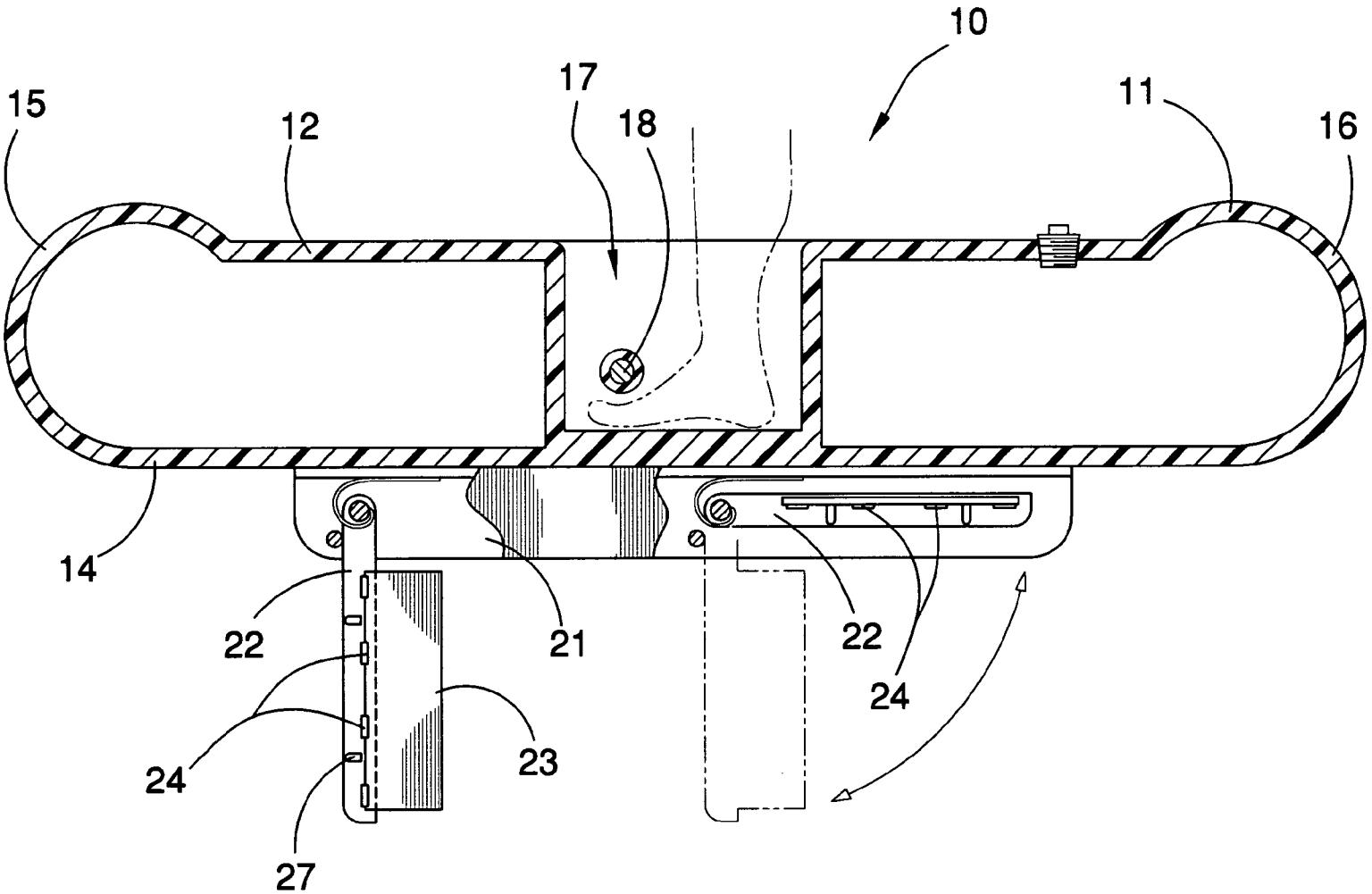
FIG. 5 is a side elevational view of a second embodiment of the present invention.
Figure 6:
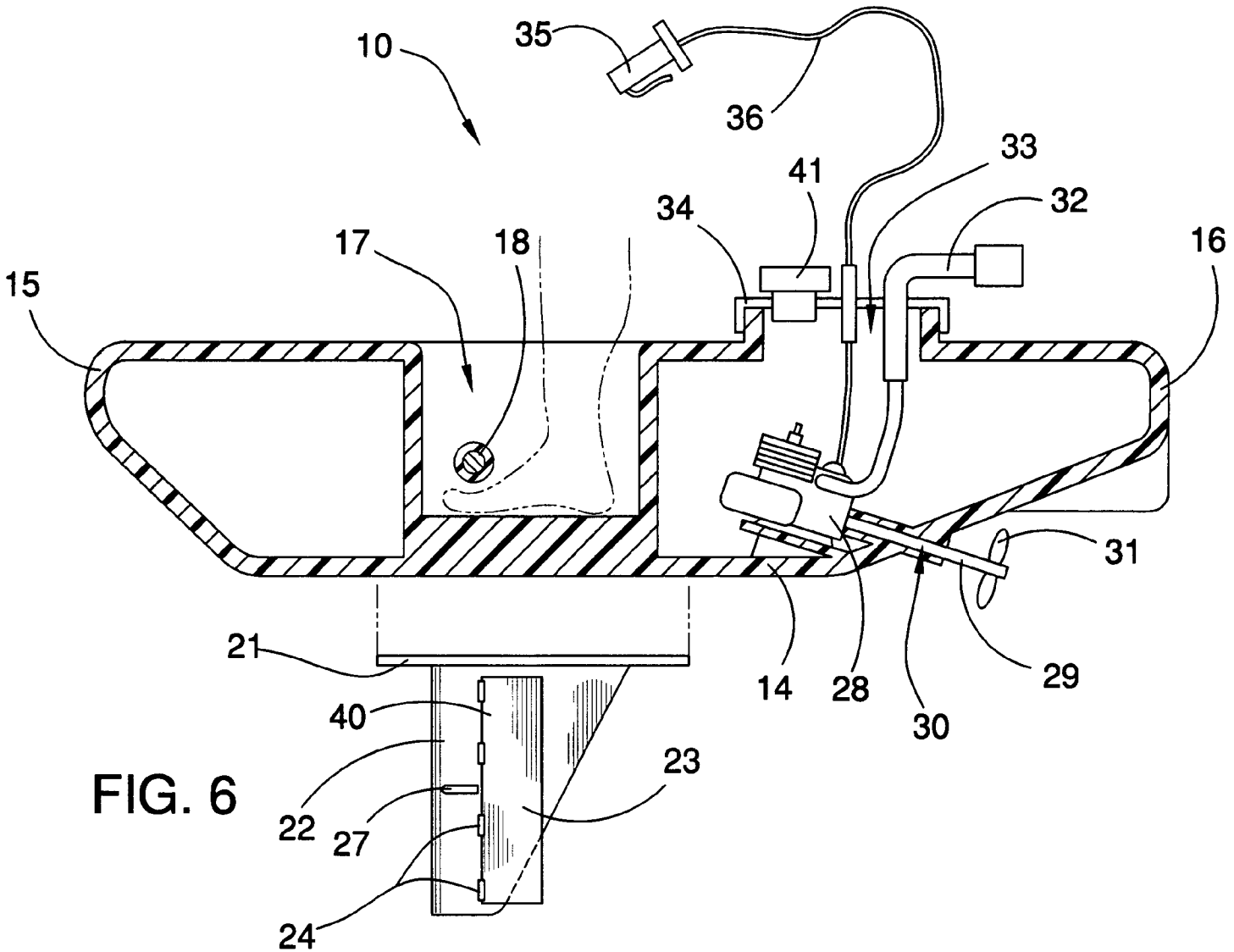
FIG. 6 is a side cross-sectional view of the present invention.
Figure 7:
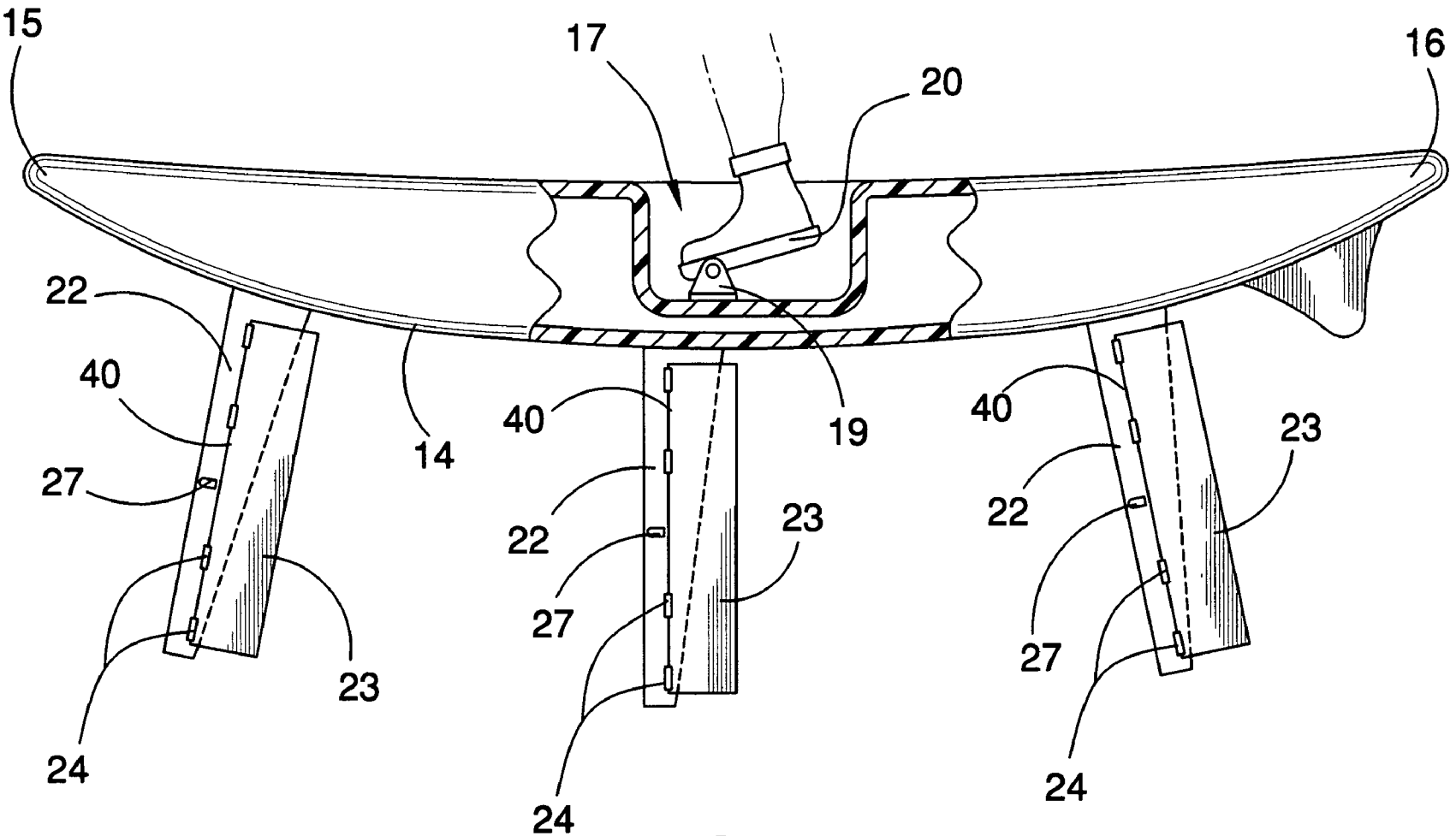
FIG. 7 is a cutaway side elevational view of a third embodiment of the present invention.
Figure 8:
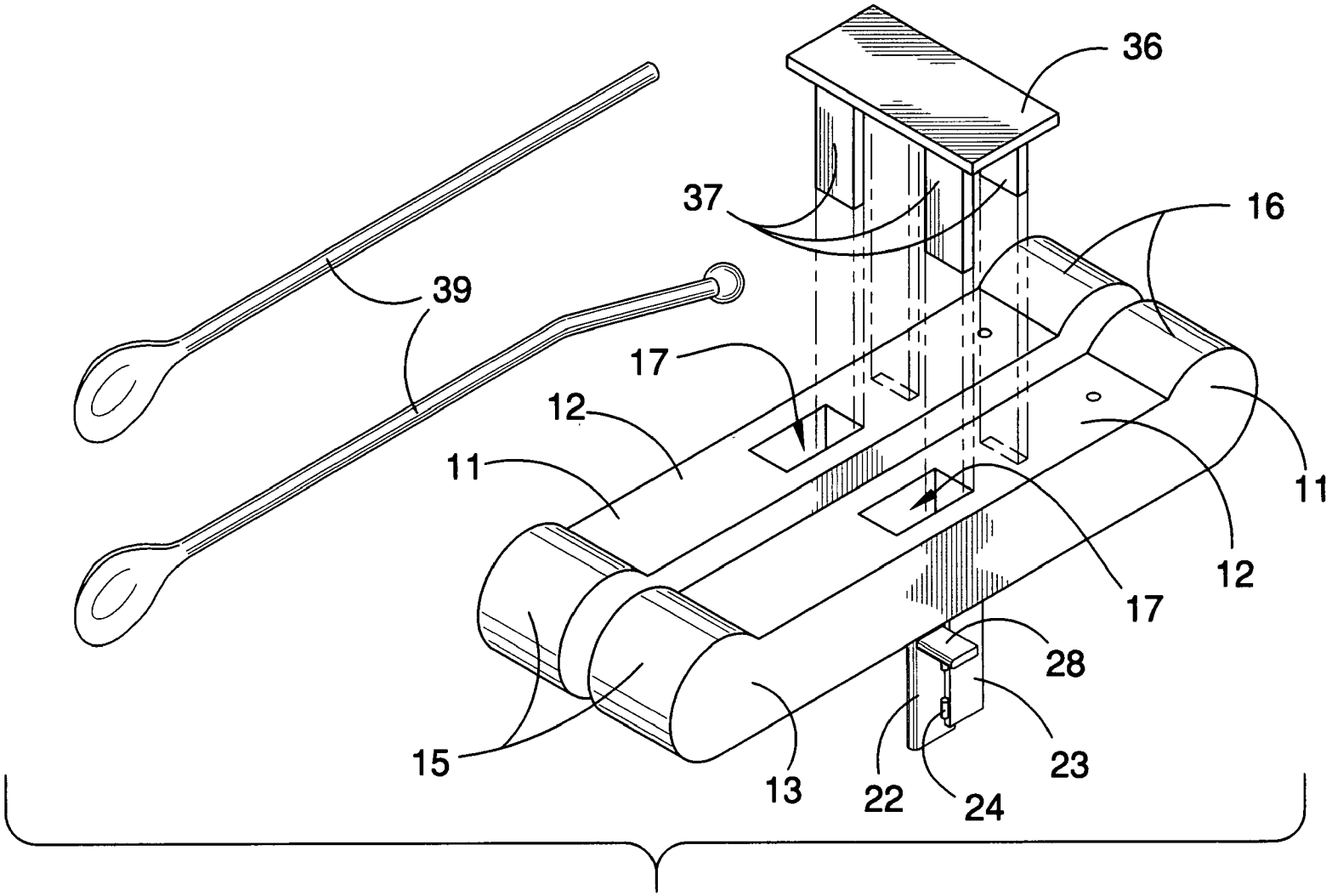
FIG. 8 is a perspective view of a fourth embodiment of the present invention.
Figure 9:
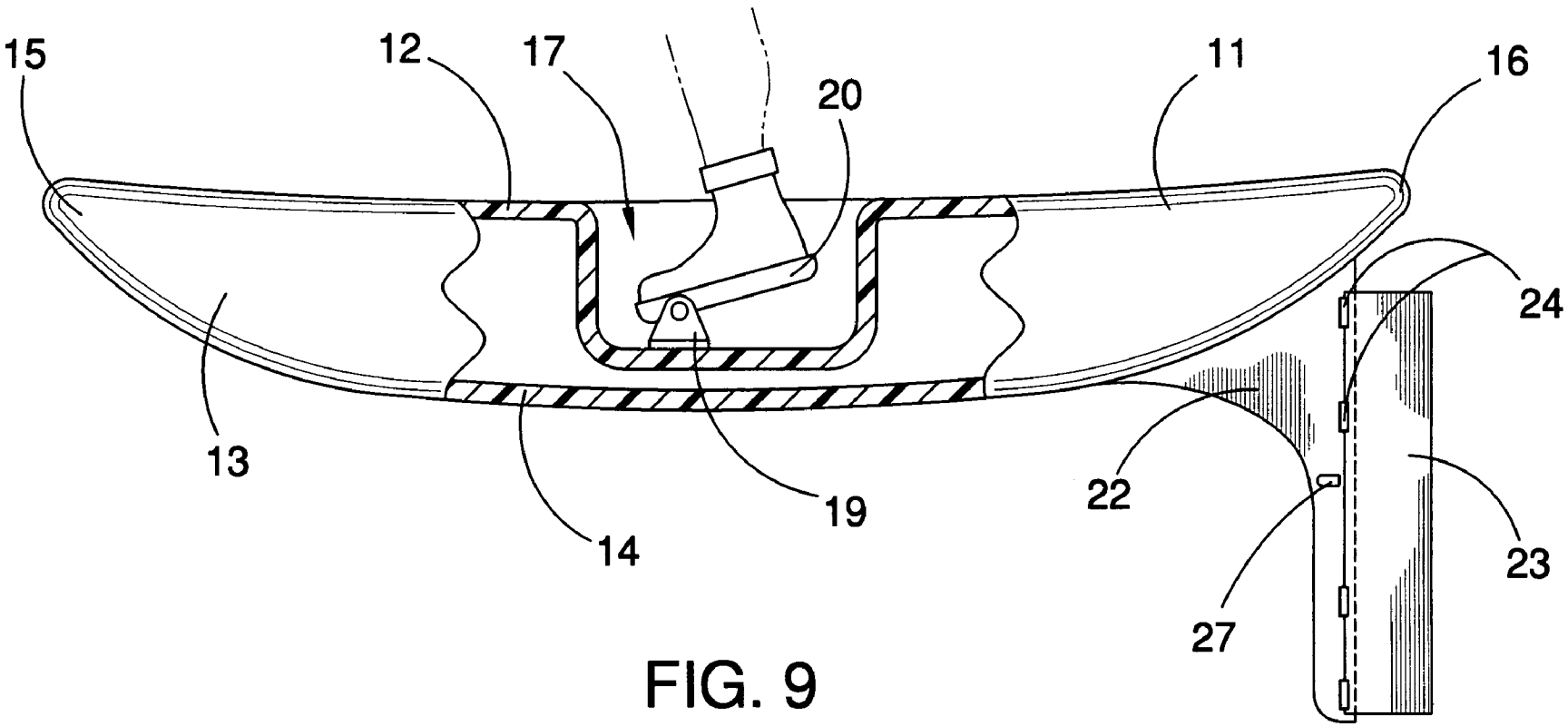
FIG. 9 is a cutaway side elevational view of a fifth embodiment of the present invention.
Figure 10:
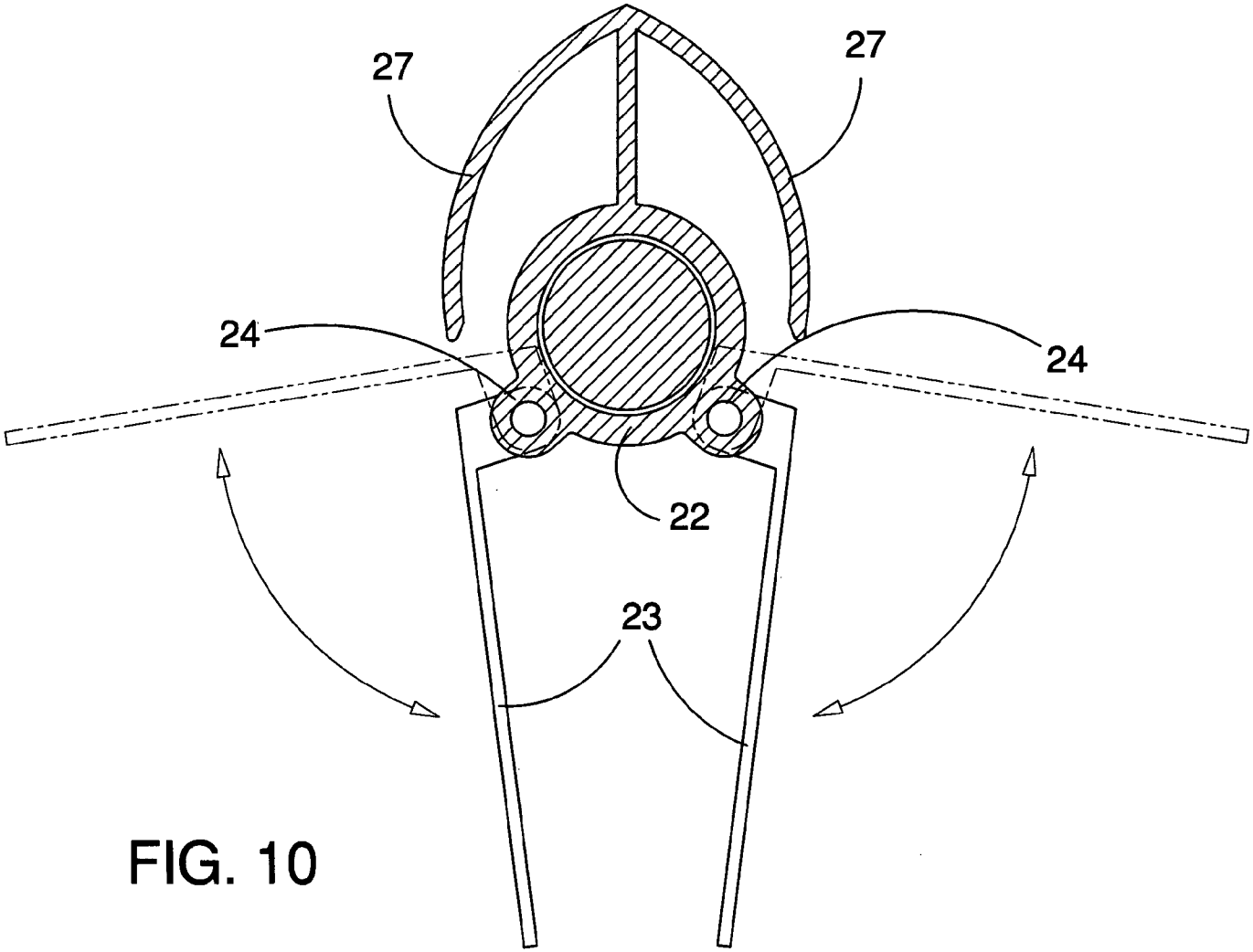
FIG. 10 is a partial bottom elevational view of a sixth embodiment of the present invention.

With reference now to the drawings, and in particular to FIGS. 1 through 10 thereof, a new personal water transport assembly embodying the principles and concepts of the present invention and generally designated by the reference numeral 10 will be described.

As best illustrated in FIGS. 1 through 10, the personal water transport assembly 10 generally comprises a floatation assembly including one or more elongate hollow floatation members 11 each having top, side, and bottom walls 12–14, and also having a foot-receiving slot 17 being centrally-disposed in the top wall 12 for receiving a user's foot. The floatation assembly further includes a foot-retaining member 18–20 being conventionally disposed in the foot-receiving slot 17 of each elongate hollow floatation member 11. Each elongate hollow floatation member 11 has rounded front and back ends 15,16, and is adapted for the user to stand upon and move with one's leg upon the water. Each elongate hollow floatation member 11 is substantially narrow relative to its length. The foot-retaining member 18–20 is a padded bar 18 being spaced above a bottom wall and being conventionally attached to side walls defining the foot-receiving slot 17 so that the user can place a front portion of one's foot under the padded bar 18 to keep the elongate hollow floatation member 11 upon one's foot. As another embodiment, the foot-retaining member 18–20 includes bracket members 19 being securely and fastenably attached to a bottom wall defining the foot-receiving slot 17, and also includes a foot pedal member 20 being hingedly and conventionally attached to the bracket members 19 so that the user can oscillate back and forth to facilitate movement of the elongate hollow floatation member 11.

A means of moving the one or more elongate hollow floatation members 11 upon water includes one or more fin support members 21 being fastened to the bottom walls 14 of the one or more elongate hollow floatation members, and further includes one or more fin members 22 being securely and conventionally attached to the one or more fin support members 21, and also includes paddle members 23 being hingedly and conventionally attached with hinge members 24 to the one or more fin members 22 with the hinge members 24 including tubular members 25 and rod members 26 being extended through the tubular members 25, and further includes stopper members 27 being conventionally attached to the fin members 22 and extending outwardly to either side thereof to stop forward movement of the paddle members 23. The paddle members 23 have front edges 40 which are hingedly attached to the fin members 22 for forward and rearward movement. As another embodiment, the fin members 22 are hingedly and conventionally attached to the fin support members 22 for pivoting toward and away from the bottom wall 14 of the one or more elongate hollow floatation members 11.

As yet another embodiment, the means of moving the one or more elongate hollow floatation members 11 upon water includes a motor 28 being conventionally disposed in the one or more elongate hollow floatation members 11, and also includes a rotatable shaft 29 being conventionally attached to the motor 28 and being extended through an opening 30 through the bottom wall 14 and near the back end 16 of the one or more elongate hollow floatation members 11, and further includes a propeller 31 being conventionally attached to a free end of the rotatable shaft 29, and also includes an exhaust pipe member 32 being conventionally attached to the motor 28 and extending through a hole in a cover member 34 being securely and removably disposed over an opening 33 through the top wall 12 of the one or more elongate hollow floatation members 11, and further includes an air intake valve 41 being conventionally disposed in the cover member 34 for allowing air to the motor 28, and also includes a power switch 35 being conventionally connected with a cord 36 to the motor 28 and being adapted to be held in a hand of the user for energizing the motor 28.

As another embodiment, the one or more elongate hollow floatation members include two elongate hollow floatation members 11 with the floatation assembly further including a detachable seat assembly being removably disposed upon the top walls 12 of the elongate hollow floatation members 11. The detachable seat assembly includes a seat member 37, and seat support members 38 being removably and engagably disposed in the top walls 12 of the elongate hollow floatation members 11.

As yet another embodiment, the means of moving the one or more elongate hollow floatation members 11 upon water includes at least one oar member 39 having an elongate handle portion and a paddle portion at an end thereof for moving the elongate hollow floatation members 11 upon the water.

In use, the user places one's foot in the foot-receiving slot 17 and moves one's leg forward and backward to move the elongate hollow floatation member 11 upon the water. As the user pushes the elongate hollow floatation member 11 forwardly the paddle members 23 will fold against the fin member 22, and as the user pushes back on the elongate hollow floatation member 11, the paddle members 23 will open up against the stopper members 27.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the personal water transport assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A personal water transport assembly comprising:

a floatation assembly including at least one elongate hollow floatation member having top, side, and bottom walls, and also having a foot-receiving slot being centrally-disposed in said top wall for receiving a user's foot, said floatation assembly further including a foot-retaining member being disposed in said foot-receiving slot of said at least one elongate hollow floatation member, said at least one elongate hollow floatation member having rounded front and back ends, and being adapted for the user to stand upon and move with one's leg upon the water, said at least one elongate hollow floatation member being substantially narrow relative to its length, said foot-retaining member being a padded bar which is spaced above said bottom wall of said at least one elongate hollow flotation member and being attached to side walls defining said foot-receiving slot of said at least one elongate hollow flotation member so that the user can place a front portion of one's foot under said padded bar and upon said bottom wall; and a means of moving said at least one elongate hollow floatation member upon water.

2. A personal water transport assembly comprising:

a floatation assembly including at least one elongate hollow floatation member having top, side, and bottom walls and also having a foot-receiving slot being centrally-disposed in said top wall for receiving a user's foot, said floatation assembly further including a foot-retaining member being disposed in said foot-receiving slot of said at least one elongate hollow floatation member said at least one elongate hollow floatation member having rounded front and back ends, and being adapted for the user to stand upon and move with one's leg upon the water, said at least one elongate hollow floatation member being substantially narrow relative to its length; and a means of moving said at least one elongate hollow floatation member upon water including at least one fin member being securely attached to said bottom wall of said at least one elongate hollow floatation member and depending therefrom, and also including paddle members being hingedly attached to said at least one fin member, and further including stopper members being attached to said fin member and extending outwardly to either side thereof to stop forward movement of said paddle members, said means of moving said at least one elongate hollow floatation member upon water including a motor being disposed in said at least one elongate hollow floatation member, and also including a rotatable shaft being attached to said motor and being extended through an opening through said bottom wall and near said back end of said at least one elongate hollow floatation member, and further including a propeller being attached to a free end of said rotatable shaft, and also including an exhaust pipe member being attached to said motor and extending through a hole in a cover member being removably disposed over an opening through said top wall of said at least one elongate hollow floatation member, and further including an air intake valve being disposed in said cover member for providing air to said motor, and also including a power switch being connected to said motor and being adapted to be held in a hand of the user for energizing said motor.

* * * * *